US005531621A

United States Patent [19]

Johnson

[11] Patent Number: 5,531,621

[45] Date of Patent: Jul. 2, 1996

[54] FORWARD PROPELLING, RETRACTABLE FLOAT TUBE FIN, WITH AUTOMATIC PROPULSION VANES

[76] Inventor: Carroll L. Johnson, 2658 Paradise Way, Grand Junction, Colo. 81506

[21] Appl. No.: 200,751

[22] Filed: Feb. 23, 1994

[51] Int. Cl.[6] ..... A63B 31/11

[52] U.S. Cl. ..... 441/61

[58] Field of Search ..... 441/55, 60–64

[56] References Cited

U.S. PATENT DOCUMENTS

| | | | |
|---|---|---|---|
| 805,525 | 11/1905 | Bullock | 441/60 |
| 3,081,467 | 3/1963 | Ciccotelli | 9/306 |
| 3,183,529 | 5/1965 | Beuchat | 9/309 |
| 3,268,927 | 8/1966 | Markowitz | 9/304 |
| 3,952,351 | 4/1976 | Gisbert | 9/304 |
| 4,664,639 | 5/1987 | Schneider | 441/61 |
| 4,857,024 | 8/1989 | Evans | 441/64 |
| 5,108,327 | 4/1992 | Klein | 441/62 |

FOREIGN PATENT DOCUMENTS

| | | | |
|---|---|---|---|
| 4020235 | 1/1992 | Germany | 441/64 |

OTHER PUBLICATIONS

Literature—"Paddle Pushers" Fishmaster Manufacturing Co., Oklahoma City, Okla., 73107.

*Primary Examiner*—Sherman Basinger

*Attorney, Agent, or Firm*—John L. Isaac

[57] ABSTRACT

A retractable fin assembly is disclosed for attachment to the boot of a float tube user. The assembly includes a fin member movable between a first position adapted for propelling the float tube user forwardly in the water and a second position adapted for retraction relative to the heel of the boot to permit walking on land by the float tube user. Propulsion vanes are carried by the fin member and have a closed position for providing substantial resistance to the flow of water as the fin member is moved in a rearward direction relative to the user. The vanes also have an open position for providing substantially reduced resistance to the flow of water as the fin member is moved in a forward direction relative to the user. Finally, a mechanism is provided for attaching the fin member to the boot of a user so that the fin member first position provides an acute angle between the fin member and the boot as the fin member projects downwardly and away from the toe of the boot, and the second position aligns the fin member behind the heel above the sole proximate the leg of the user.

20 Claims, 7 Drawing Sheets

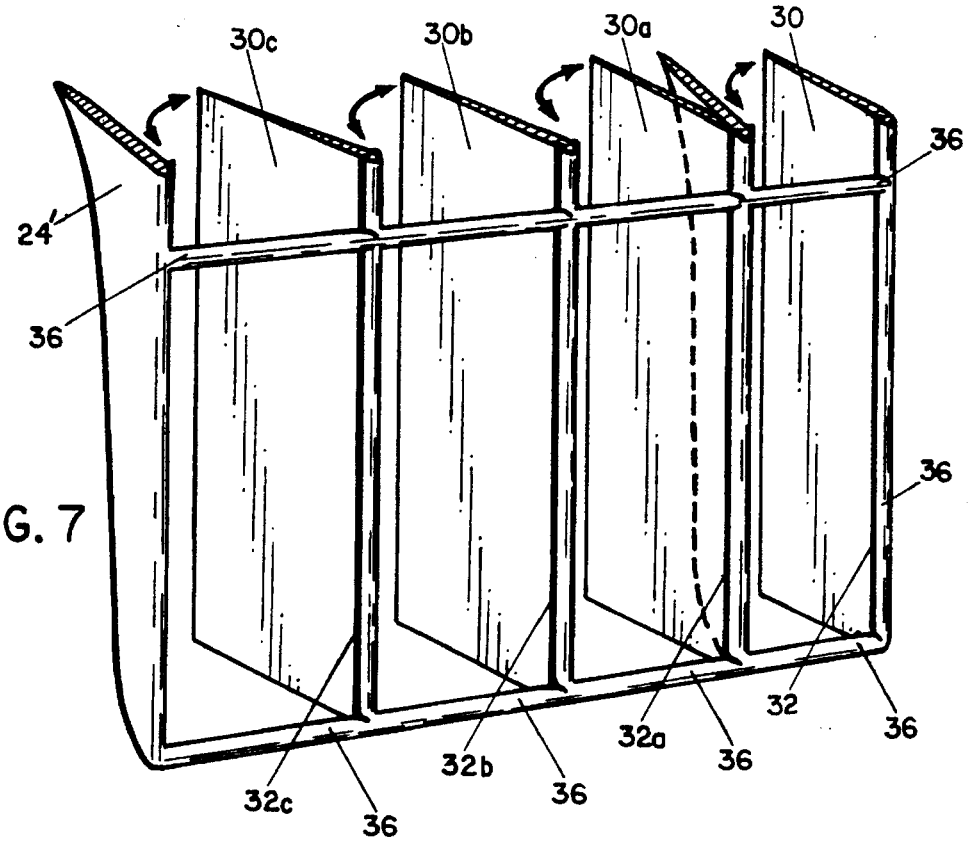
FIG. 7
FIG. 7A
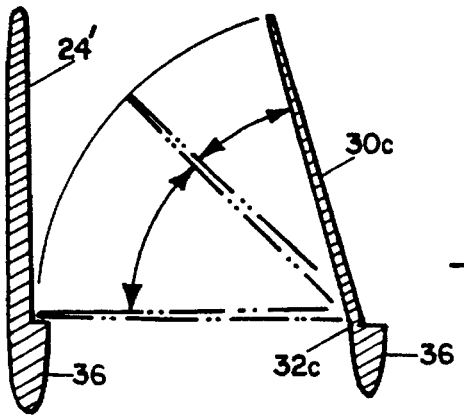
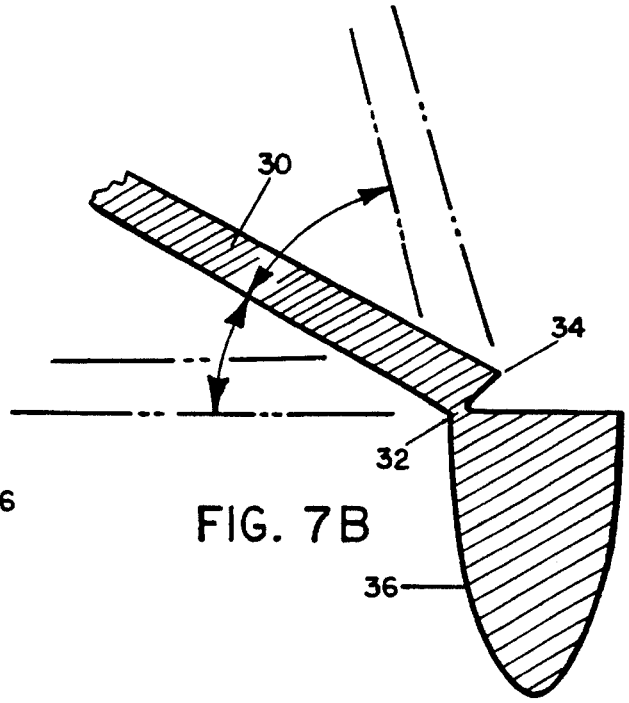
FIG. 7B

FIG. 8
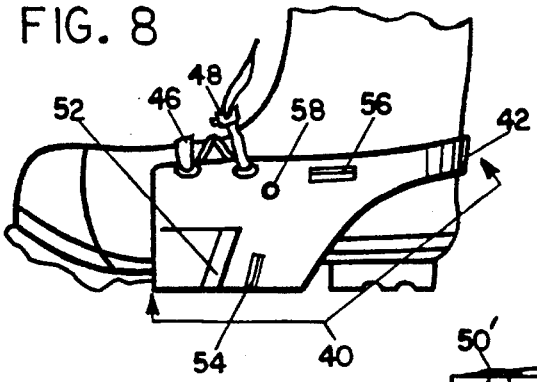
FIG. 8A
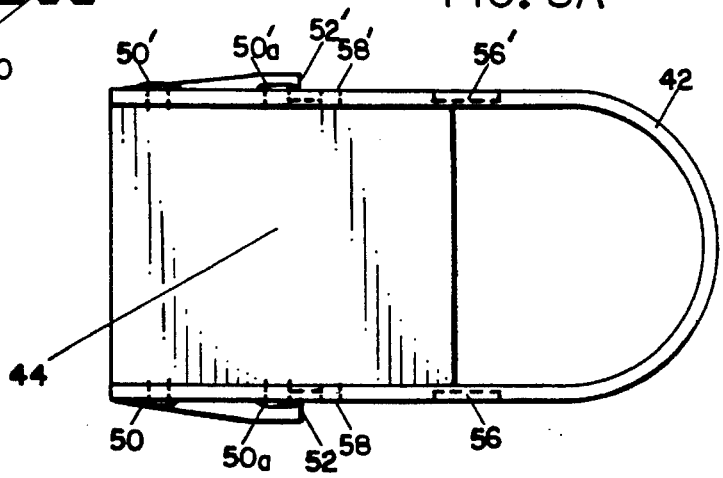
FIG. 8B
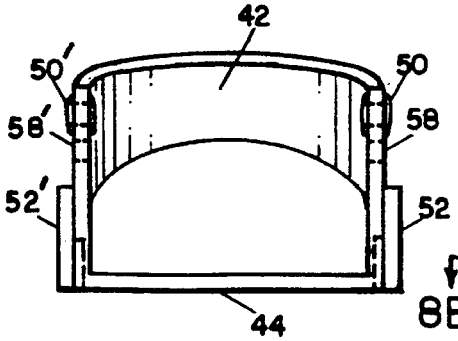
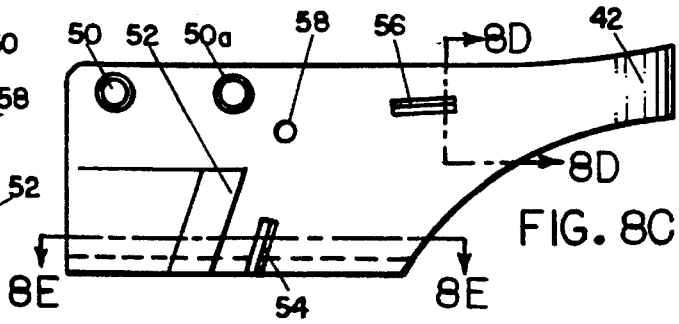
FIG. 8C
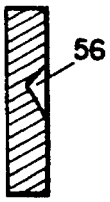
FIG. 8D
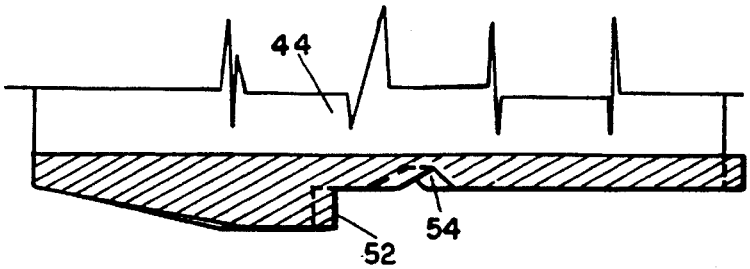
FIG. 8E

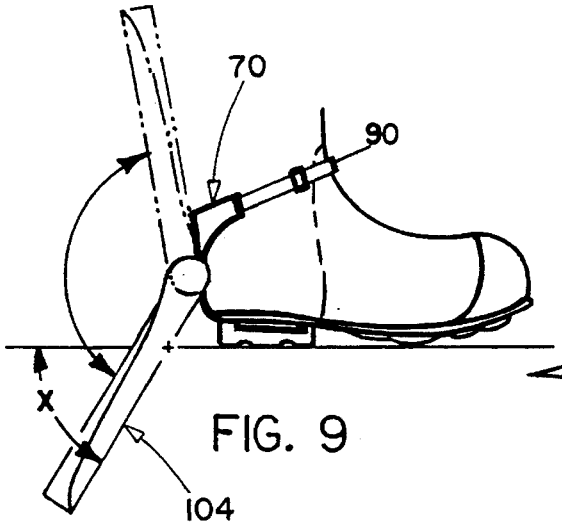
FIG. 9
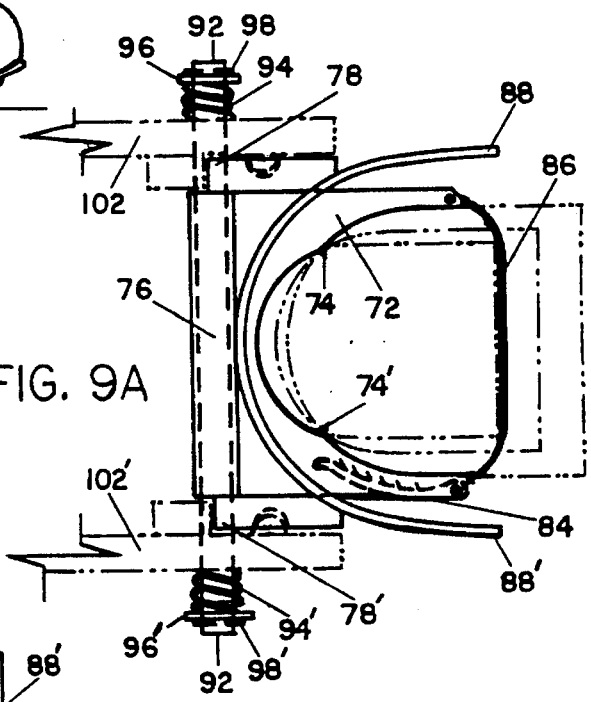
FIG. 9A
FIG. 9B
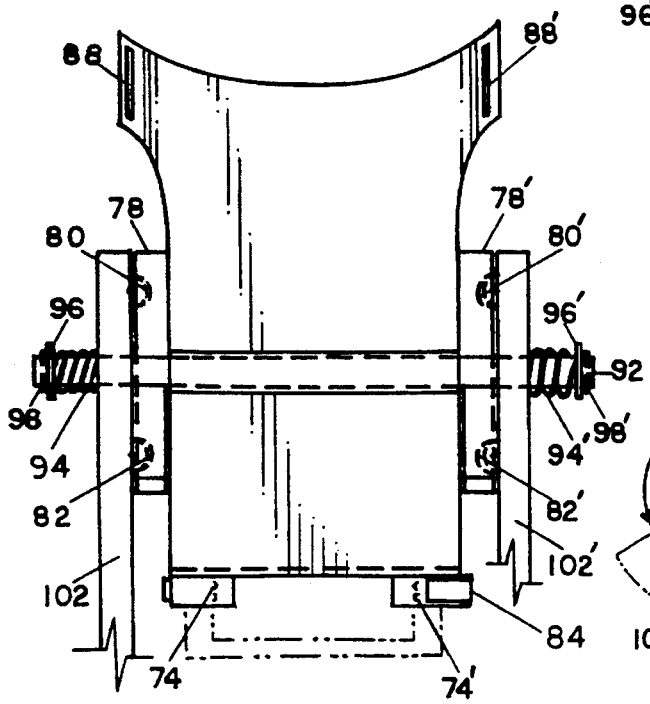
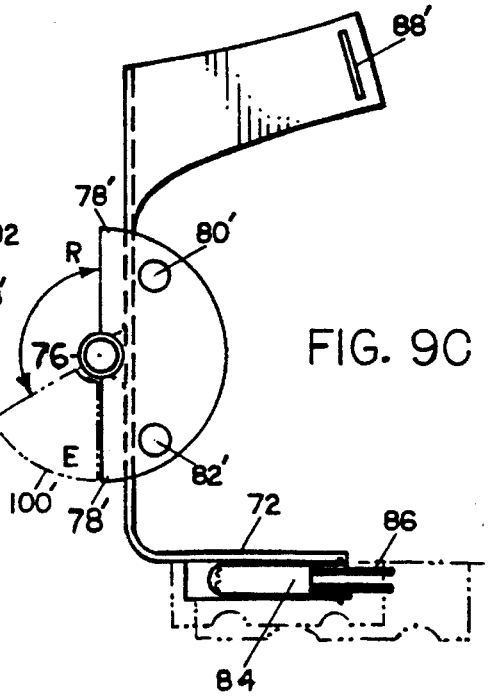
FIG. 9C

FORWARD PROPELLING, RETRACTABLE FLOAT TUBE FIN, WITH AUTOMATIC PROPULSION VANES

BACKGROUND

1. Field of Invention

This invention relates to float tubes commonly used in fishing, specifically to an improved foot fin for propelling a float tube.

2. Description of Prior Art

Most float tube fins are similar in design to the foot fins used by swimmers and divers. They operate by movement of the user's legs and feet in a "flutter kick" which propels a float tube to the rear (backward). This direction is opposite to the direction a float tube user normally wishes to move in pursuing rising fish, or in moving to other locations. Efficiency of the prior art fins is low. Use of them in traveling a distance is strenuous and tiring.

The forward extension of the fin blade limits normal foot movement, creating a risk of falling while walking with the fins on. Walking in marginal water to enter or exit a body of water is particularly hazardous, for in addition to the clumsiness of the protruding fin and the restriction of movement and visibility caused by the float tube, the walker has to overcome the water's resistance on the fin with each step. As a consequence, most users of forward extending prior art fins walk backward to enter and exit the water. Walking backward with a bulky float tube in place creates a danger of falling and injury.

The process of donning and removing a ring-shaped float tube while wearing the forward extending prior art fins is also difficult and hazardous, as described:

(a) The bulk and shape of a float tube limits movement, necessitating that the fins are attached to the user's feet prior to donning the float tube.

(b) With the float tube laying flat on the ground the user balances on one foot while stepping over the circumference of the tube with the other foot, inserting said other foot into the leg opening of the float tube seat.

(c) Thus straddling the tube, the user shifts his/her balance to the foot now inside the tube, lifting the opposite (first said) foot over the tube, to insert it also into the leg opening of the seat.

(d) At this point balancing is especially difficult, presenting a danger of falling. The forward extension of the fin, its general configuration and size, and the constriction of the seat makes it awkward to insert both feet into the leg opening of the float tube. Balancing is especially difficult while bending over to maneuver the unwieldy tube into position to facilitate inserting the fin of the second foot into the leg opening.

(e) Removal of the float tube is the reverse of the process of donning it.

Two fins designed to provide a means of forward propulsion of a float tube are currently on the market. Use of either of them compels the user to assume a forced, un-natural position in the float tube. Both prior art forward propelling fins are inefficient in use.

One is based on U.S. Pat. No. 4,664,639 to Schneider (1987) which illustrates a fin to be used by a vertically positioned tube fisherman. The fin described is flexibly attached at the toe to deflect, extending underneath the sole of the fisherman's foot. In actual use, the design and construction of float tube seats places a user in the posture of a person seated in a chair, with his/her legs and feet extended in front. Use of the fin described in this patent requires the user to lean forward against the designed posture of the float tube to position his/her legs in a vertical plane. A currently marketed product based on the aforementioned patent ("KICKAPOO KICKERS") has a fin that is quite stiff and rigid. It does not deflect enough to cause an effective drag against the water. Much of the leg motion in using this fin is wasted in movement to cause water resistance to flex the fin into a position where it could become effective. By the time the fin is extended to this position, the stride has been nearly completed, and little further range of leg motion is left to propel the user. The fin impairs one's ability to walk on uneven surfaces, especially in marginal water on rocky bottoms or where debris has settled to the bottom. The smooth hard lower surface of the fin does not grip uneven surfaces well, adding to the problem of walking in rocky marginal water.

The other forward propelling prior art fin ("PADDLE PUSHERS") also compels its user to assume a forced, upright position to move through the water. This product operates by a hinged fin extending outboard to the side of the user's foot. The fin of this product is too small to create an effective propulsive force. If the product were constructed with a larger fin, thrust from the fin (because of its location outboard of the user's leg and foot) would tend to rotate, or yaw the tube, rather than to be applied in the desired forward direction.. As with U.S. Pat. No. 4,664,639 to Schneider (1987), much of the user's leg motion is wasted in causing the fin to open from its folded position to the extended position where it could be effective.

OBJECTS AND ADVANTAGES

Accordingly, several objects and advantages of my invention are:

(a) to provide an effective float tube fin for forward propulsion, in the direction which the user faces;

(b) to provide a more efficient fin, using less energy for movement;

(c) to provide a less cumbersome fin, for greater ease in the movements of donning and removing a float tube;

(d) to provide a retractable fin allowing the user to walk in a normal manner, reducing the danger of falling and injury;

(e) to provide a simple, easy to operate, latching device to secure the retractable fin in both the extended and retracted positions;

(f) to provide a fin which in use is located below the user's foot, as a longer extension of the user's leg, thereby creating greater leverage and thrust;

(g) to provide a fin which in use is located below the user's foot, close to the vertical center line of the user's body, eliminating side to side yawing and wasted energy; and (h) to provide a fin that is universally adaptable to fit a wide range of sizes and types of footgear normally used by float tubers.

Further objects and advantages of my invention will become apparent from a consideration of the drawings and ensuing description.

DRAWING FIGURES

In the drawings, closely related figures have the same number, but different alphabetic suffixes.

FIG. 7 shows the same section of the fin as FIG. 6C, viewed from the opposite side.

FIG. 7A shows an enlarged view of the fin extension arm and one propulsion vane from the left side of FIG. 7.

FIG. 7B shows an enlarged cross-section view of a propulsion vane, and details of a propulsion vane hinge.

FIGS. 8, 8A, 8B, & 8C show a foot-attachment member with the fin assembly removed to show construction details.

FIGS. 8A, 8B, & 8C show three-view drawings of the previously described foot-attachment member.

FIG. 8D shows a cross-section of the foot-attachment member in FIG. 8C at section 8D.

FIG. 8E shows a cross-section of the foot-attachment member in FIG. 8C, at section 8E.

FIGS. 9, 9A, 9B, & 9C show an alternate attachment to the heel of footgear normally worn by float tube users.

Figure 10:
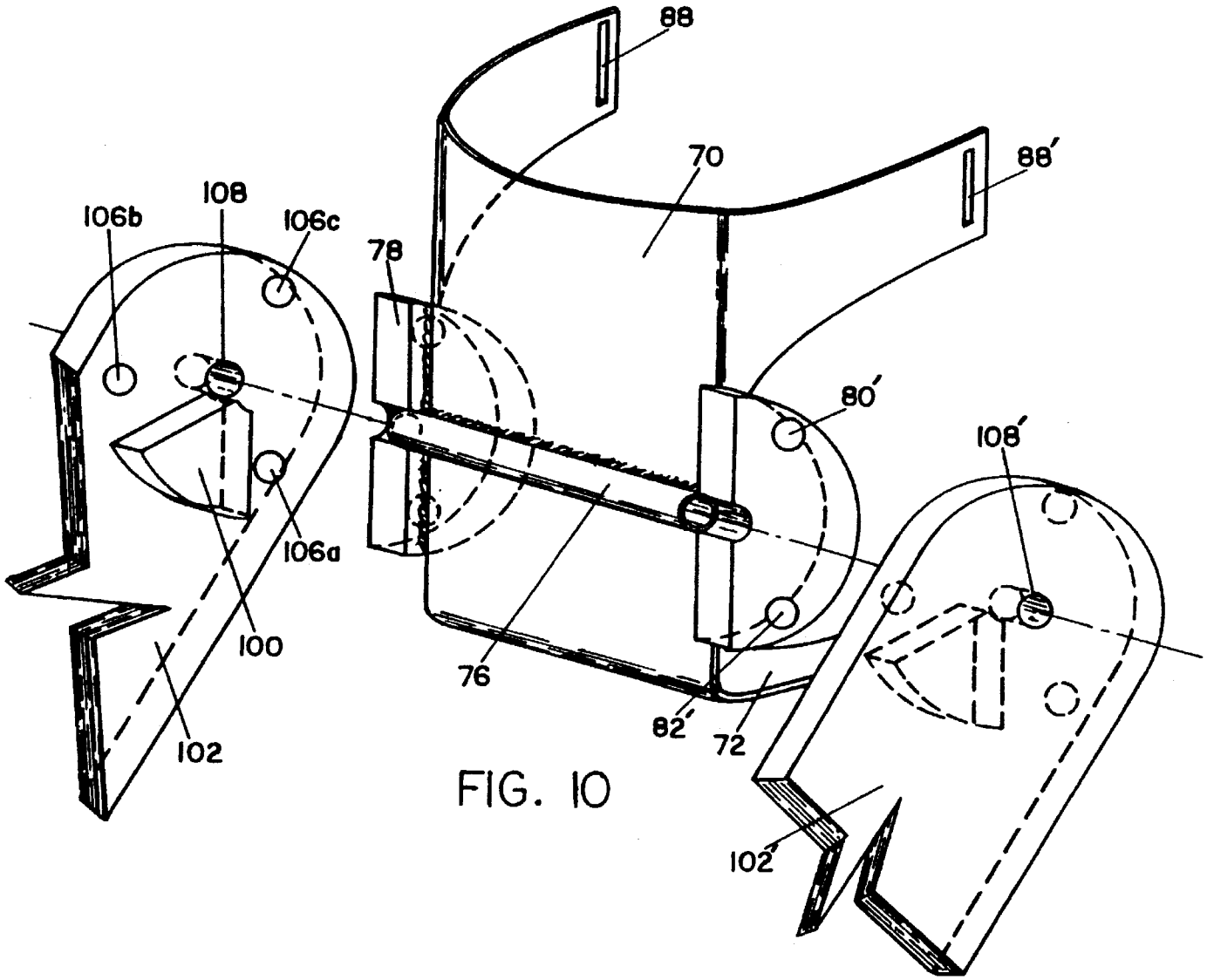

FIG. 10 is an exploded view of the alternate heel attachment member, showing details of the fin pivot and latching mechanism.

Reference Numerals in Drawings

| | |
|---|---|
| 20 fin assembly | 30 propulsion vane |
| 22 fin pivot hole | 32 propulsion vane hinge |
| 24 fin extension arm | 34 propulsion vane stop |
| 26 latch dog | 36 propulsion vane frame |
| 28 latch spring | |
| 40 foot-attachment member | |
| 42 foot-attachment heel strap | 52 fin extension arm stop |
| 44 foot-attachment sole | 54 extended position detent |
| 46 foot-attachment lacing | 56 retracted position detent |
| 48 foot-attachment lace lock | 58 rivet hole |
| 50 lace grommets | 60 pivot rivet |
| 70 heel attachment member | 90 ankle strap |
| 72 heel plate | 92 fin pivot shaft |
| 74 heel locating tab | 94 fin retaining spring |
| 76 fin pivot guide | 96 fin retaining washer |
| 78 fin stop member | 98 pivot retaining pin |
| 80 upper detent | 100 fin stop dog |
| 82 lower detent | 102 alternate fin arm |
| 84 heel buckle | 104 alternate fin assembly |
| 86 heel cable | 106 fin detent ball |
| 88 strap fitting | 108 alt. fin pivot hole |

DESCRIPTION - FIGS. 1 TO 10

The fin of this invention is constructed primarily of molded semi-rigid plastic material, although other strong, lightweight, water and corrosion resistant materials (like aluminum) could be used integral with plastic materials, or as a substitute for plastic material for some parts. Where, for simplicity, the drawings show only the left fin or a sub-assembly of one fin, and/or the description uses a singular word form or reference numeral, it should be understood that there are paired left and right fins, some left and right sub-assemblies, and some multiple similar parts. In the drawings, whole numbers indicate a complete assembly, or left side part. Whole numbers followed by an alphabetic suffix indicate multiple similar parts, or multiple similar left side parts. Whole numbers with ' suffixes indicate right side parts. Whole numbers with ' suffixes, followed by an alphabetic suffix, indicate multiple similar right side parts. The drawings and description are not intended to convey the impression of there being only one, but rather to indicate paired fins and sub-assemblies. Two different foot-attachment members are illustrated and described. Although one foot attachment member is illustrated and described first, and the other as an alternate, this is not to give a primary importance to either. Each foot-attachment member is of equal importance, although each is adaptable to different types of footgear.

Figure 1:
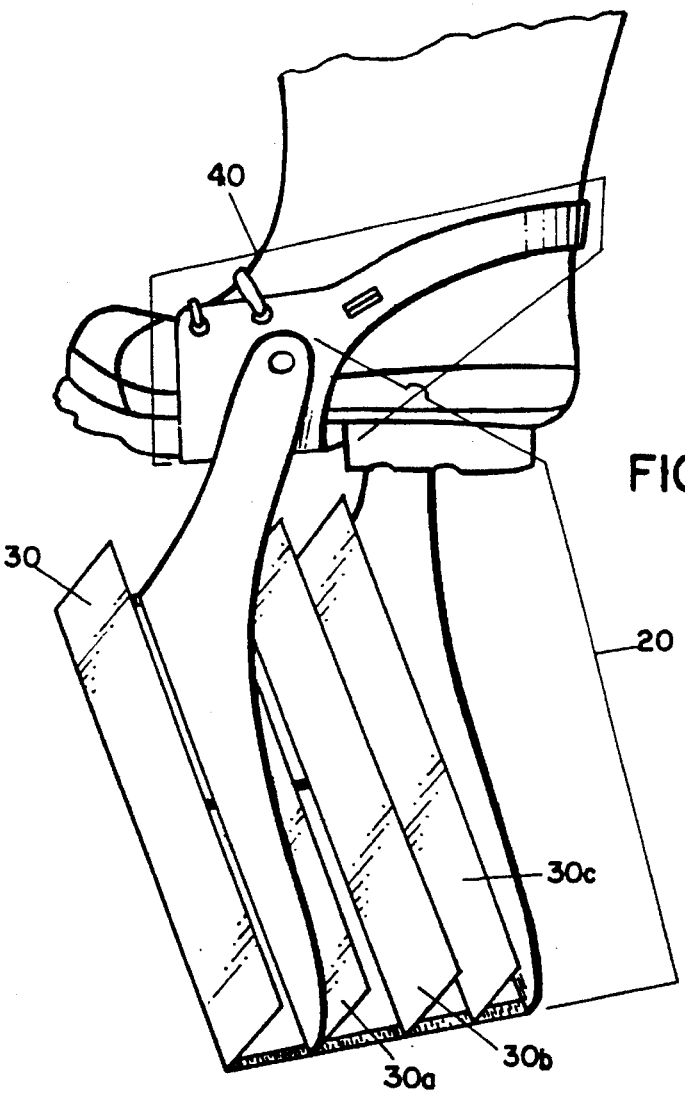
FIG. 1 shows the fin in the extended position for use in the water.

FIG. 1 shows a complete foot fin, viewed from the rear and outside of the wearer's left foot. The right fin is similar, but opposite. This view shows a float tube user's retractable foot fin comprising in combination, a foot-attachment member 40 as a pivotal means of attaching a fin assembly 20 to a user's foot, such that fin assembly 20 can be aligned relative to the user's foot in a plurality of positiions, for use in propelling a float tube in the water and for walking in marginal water and on land. Fin assembly 20 is shown in the extended position for use in the water. Propulsion vanes 30 are formed integral with fin assembly 20 to be positioned at rest in a partially open position as shown in FIG. 1.

Figure 2:
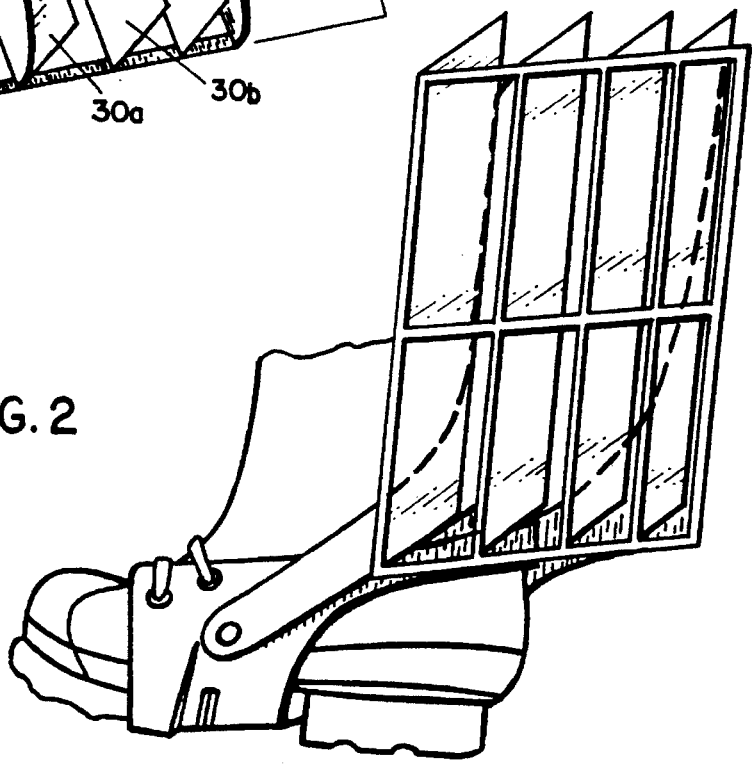
FIG. 2 shows the fin in the retracted position for walking, and while donning and removing a float tube.

FIG. 2 shows fin assembly 20 in its retracted position essentially in a vertical plane parallel and adjacent to the user's calf. In this position fin assembly 20 is clear of contact with the earth, so it does not interfere with walking or other movement.

Figure 3:
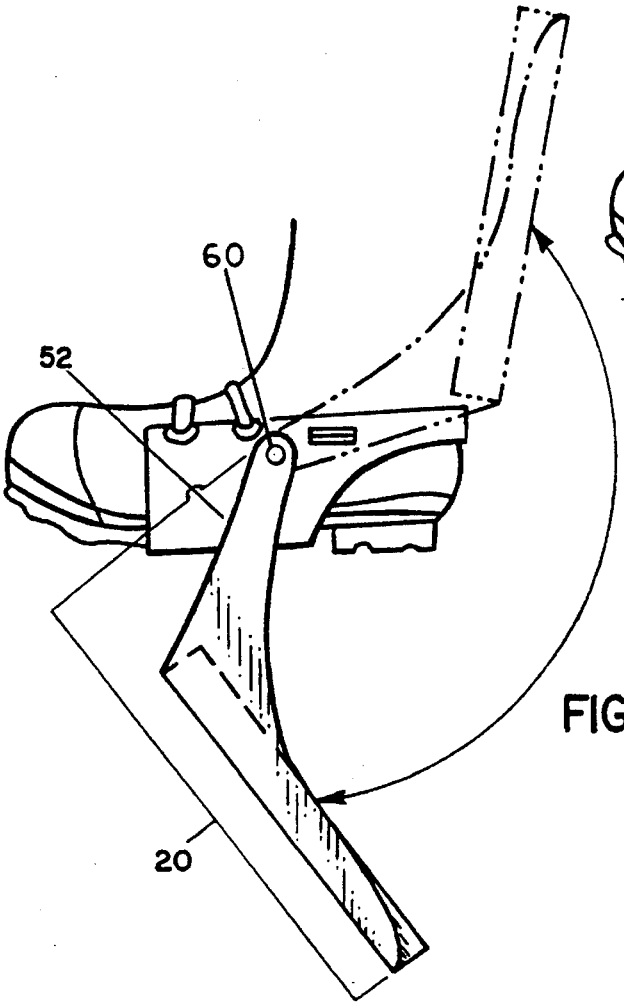
FIG. 3 shows the fin pivoting between the extended and retracted positions.

FIG. 3 shows the "sweep" or range of motion of fin assembly 20 moving around a pivot rivet 60 between the extended and retracted positions. Fin assembly 20 is held at a predetermined position relative to the user's foot by a fin extension arm stop 52 and a spring releaseable latching means shown and described in greater detail in FIGS. 8, 8A, 8B, 8C, 8D, & 8E.

Figure 4:
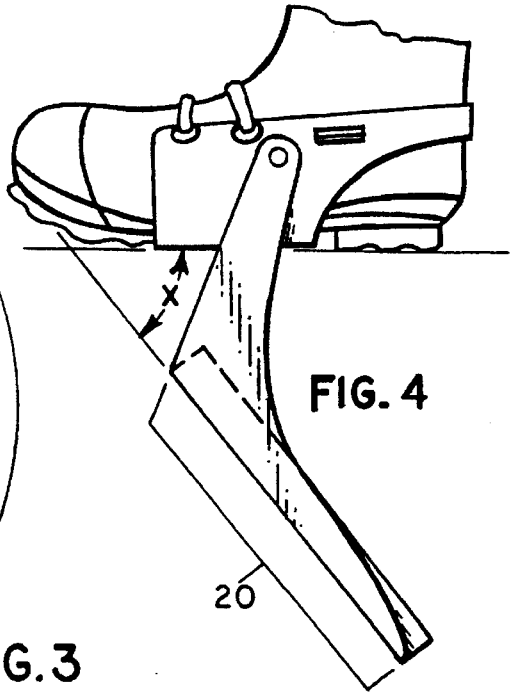
FIG. 4 shows the angle of the fin to the sole of the user's foot, indicated as angle X.

FIG. 4 shows the predetermined angular positioning (angle X) of fin assembly 20 relative to the sole of the user's foot when fin assembly 20 is in the extended position. This orientation places fin assembly 20 at the mean optimum angle of attack to develop maximum thrust as the user's legs are moved to propel the float tube. This will be more clearly understood from consideration of the illustration of normal leg movement of a float tube user shown in FIG. 5. I believe the mean optimum angle is approximately 55° to 75°, although I do not wish to be bound by this.

Figure 5:
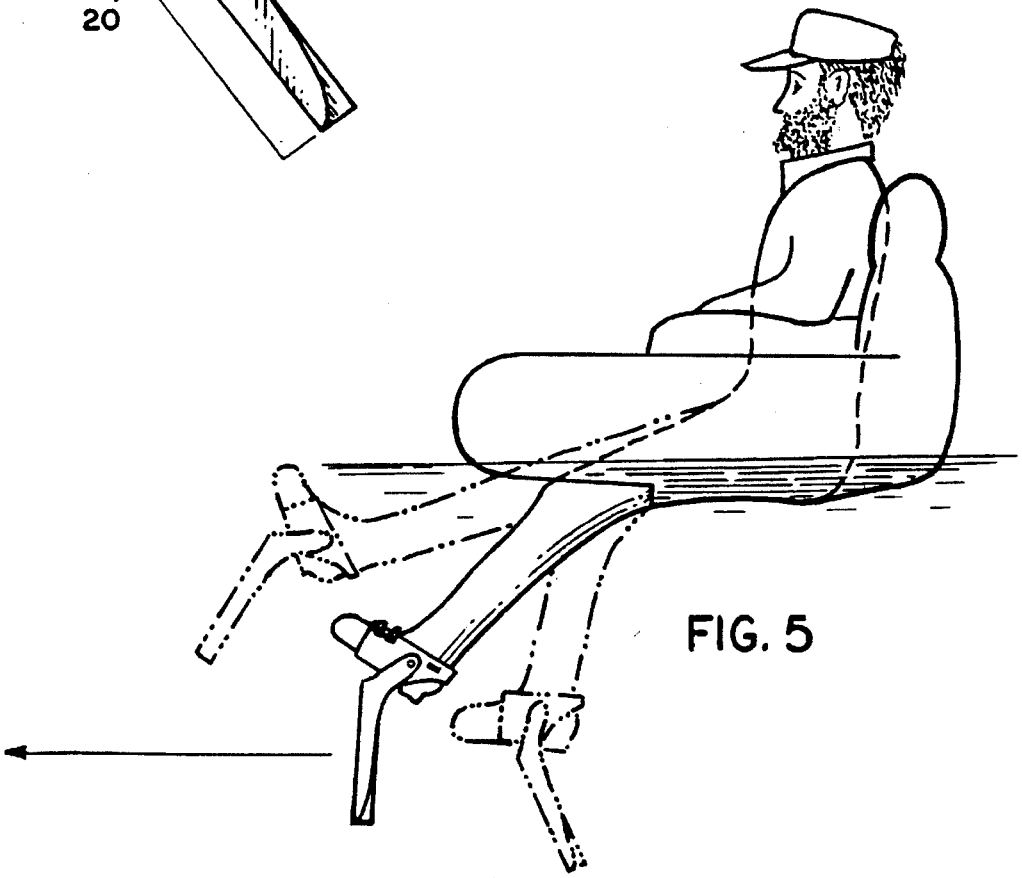
FIG. 5 shows the normal posture, and approximate range of leg motion of a person seated in a float tube.
Figure 6:
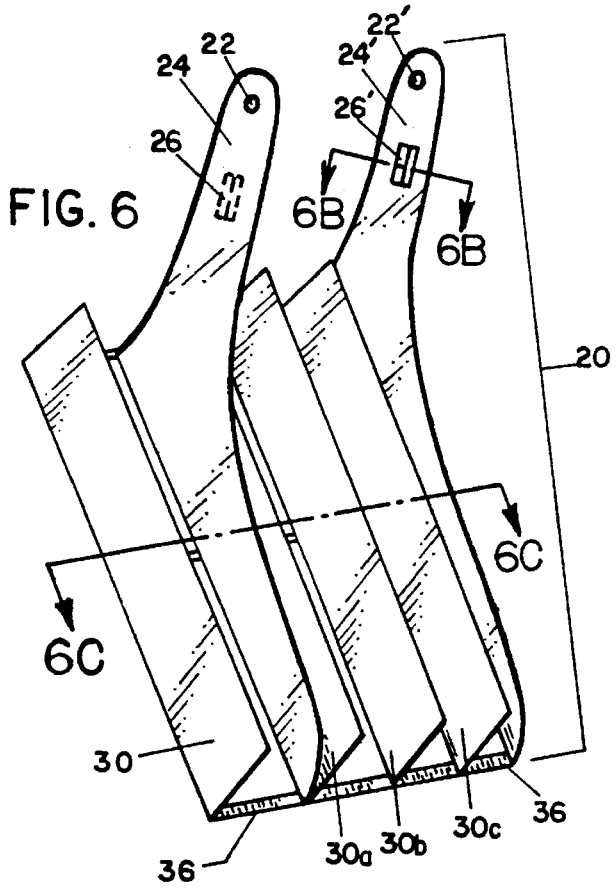
FIG. 6 shows the complete fin assembly removed from the foot-attachment member to show construction details.

FIG. 5 shows the normal posture and approximate range of leg and foot motion of a person seated in a float tube in the water. Notice that the design and construction of the seat places a user in the posture of a person seated in a chair, with his/her legs and feet extended in front. The limited range of leg movement and posture of the user are factors in determining the angle of fin assembly 20 to the sole of the user's foot as discussed in the description of FIG. 4. In this orientation, the plane defined by propulsion vanes 30 when in a closed position is substantially perpendicular to its general direction of movement through the water FIG. 6 shows fin assembly 20 removed from foot-attachment member 40 to show construction details. Fin assembly 20 is viewed from the same position as in FIG. 1. Fin assembly 20 comprises fin extension arms 24 a propulsion vane frame 36 propulsion vane hinges 32 (illustrated in detail in FIG. 7B) and propulsion vanes 30. Fin extension arms 24 are fastened to foot-attachment member 40 by pivot rivets 60 (indicated in FIG. 3)passing through fin pivot holes 22. Fin assembly 20 is retained in the extended and retracted positions by latch dogs 26 formed integral with fin extension arms 24. Latch dogs 26 fit into detents 54 & 56 formed in foot-attachment member 40 shown in FIGS. 8C, 8D, & 8E.

Figure 6A:
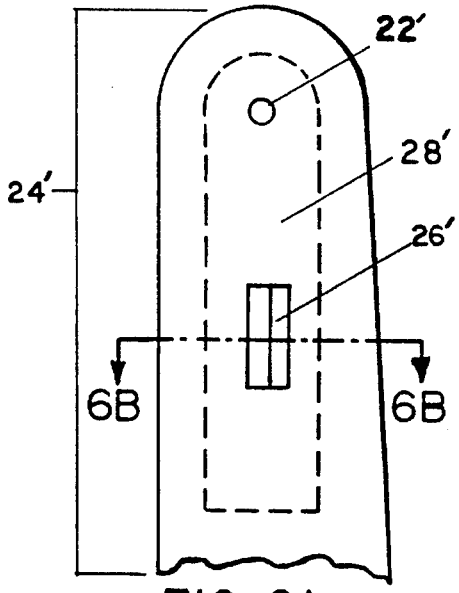
FIG. 6A shows the fin extension arm in FIG. 6, and details of the latch dog and latch spring.
Figure 6B:
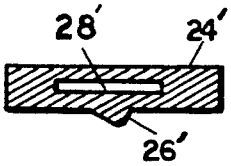
FIG. 6B is a cross-section of the fin extension arm in FIGS. 6 and 6A, showing details of the latch dog and latch spring.

FIGS. 6A & 6B are enlarged drawings of the upper portion of the inside fin extension arm 24 shown in FIG. 6. FIG. 6B is a cross-section view showing latch dog 26 in more detail, and a flat latch spring 28 formed integral within fin extension arm 24. Latch spring 28 exerts pressure against latch dog 26 to retain latch dog 26 in the appropriate detent (as shown in FIGS. 8C, 8D, & 8E) when fin assembly 20 is in either the extended or retracted position. Both extension arms of each fin are similar, but opposite.

Figure 6C:
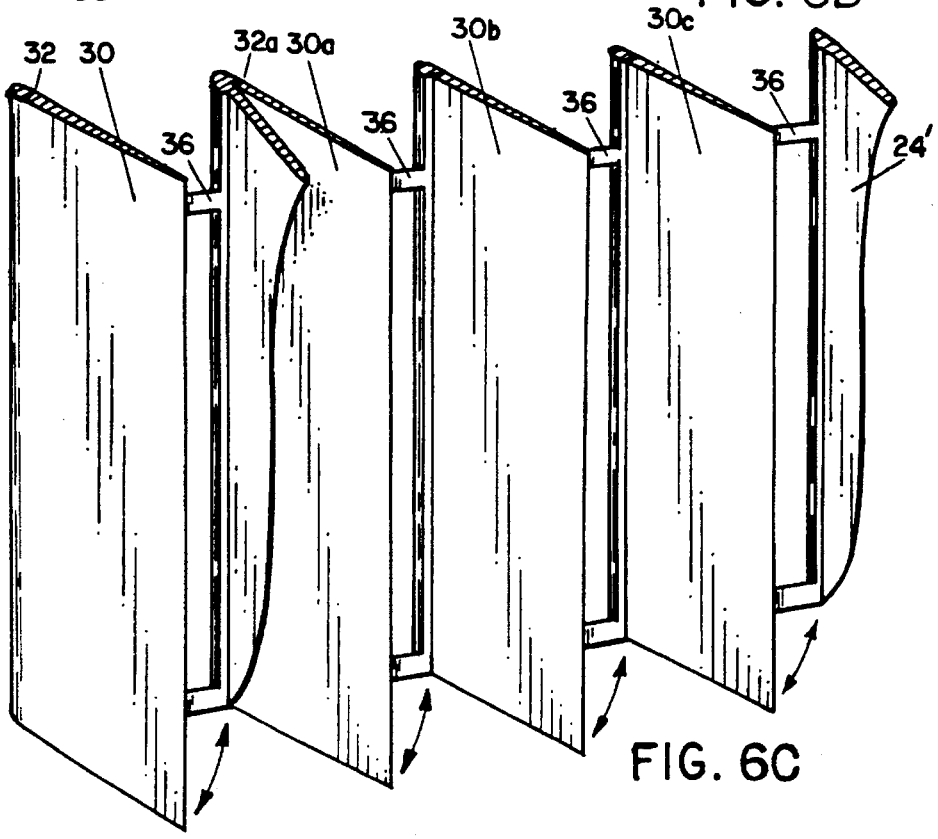
FIG. 6C is a section of the lower portion of the fin in FIG. 6, showing cross-section details of the fin assembly, and rotation of the hinged propulsion vanes in opening and closing.

FIG. 6C shows a section of the lower portion of fin assembly 20. The drawing shows cross-section details of fin extension arms 24, propulsion vane frame 36, propulsion vane hinges 32 and propulsion vanes 30. Arrows at the bottom of the illustration indicate the rotation of propulsion vanes 30 to the open and closed positions. Propulsion vanes 30 function in combination within fin assembly 20 as a flow controlling device to cause fin assembly 20 to have a directionally differential resistance to movement through the water as a means of propelling a float tube forward in the water by movement of the user's legs in a forward and backward striding motion.

FIG. 7 is the same section of fin assembly 20 shown in FIG. 6C, viewed from the opposite side, showing the leading or forward side as the user faces, with the fin in the extended position. The illustration shows fin extension arms 24 formed integral with propulsion vane frame 36. Propulsion vanes 30 are attached by propulsion vane hinges 32 formed integral with propulsion vane frame 36 (Shown in greater detail in FIGS. 7A & 7B).

FIG. 7A shows an enlarged view of fin extension arm 24 and one propulsion vane 30 from the left side of FIG. 7. Rotation of propulsion vane 30 is shown in traveling between the full open and closed positions.

FIG. 7B shows a more greatly enlarged cross-section view of one of the propulsion vanes 30 (typical—all vanes are similar) showing details of the live propulsion vane hinge 32 (also known to the plastics industry as a "living hinge") formed integral with propulsion vane 30 and propulsion vane frame 36. Hinge 32 is formed to position vane 30 in a medial position minimizing the amount of movement to either the fully closed or open position. In its most fully open position propulsion vane 30 is retained in a slightly less than full open position by a propulsion vane stop 34 formed as part of propulsion vane 30. When the user's leg is moved toward the rear, pressure against the water causes the slightly less than full open vane 30 to hinge to its fully closed position, stopped by propulsion vane frame 36 (As shown in FIG. 7A). In the fully closed position, propulsion vanes 30 incur maximum resistance to movement through the water, creating a forward thrust.

FIGS. 8, 8A, 8B, & 8C show foot-attachment member 40 with fin assembly 20 removed to show construction details. Foot-attachment member 40 is secured to the user's foot by a foot-attachment heel strap 42, a foot-attachment sole 44 and a foot-attachment lacing 46. Foot-attachment lacing 46 is retained securely fastened by knotting or by a lace lock 48. Lace locks (also known as cord locks) are a widely known and commonly available item from camping equipment suppliers. Lace grommets 50 are set in foot-attachment member 40 to reinforce member 40 against wear and abrasion of lacing 46. A pivot rivet 60 (indicated in FIG. 3) passes through rivet hole 58 in foot-attachment member 40 and fin pivot hole 22 formed in fin extension arm 24 to attach fin assembly 20 to foot-attachment member 40 as a complete unit. This fastening allows fin assembly 20 to hinge or pivot from either the extended or retracted position to the opposite position. A fin extension arm stop 52 is formed integral with foot-attachment member 40 to retain fin assembly 20 in its most forward extended position. In this stopped position, with propulsion vanes 30 in the closed position, movement of the fin to the rear against the resistance of the water generates a thrust propelling the float tube in a forward direction. On movement of the user's leg to the front, fin assembly 20 is retained in the extended position by latch dogs 26 which are held secure in the extended position detents 54 by latch springs 28. In the retracted position, detents 56 formed in foot-attachment member 40 interact with latch dogs 26 and latch springs 28 to retain fin assembly 20 in position. The sides of latch dog 26 and detents 54 and 56 slope at an angle so that pressure from the opposite foot or pressure against the earth at the bottom of a body of water can overcome the resistance of latch spring 28 allowing fin assembly 20 to be pivoted to the other position.

FIGS. 8D & 8E show cross-section details of fin extension arm stops 52, extended position detents 54 and retracted position detents 56.

FIGS. 9, 9A, 9B, & 9C show an alternate attachment with the fin attached to the heel of wading footgear normally worn by a float tube user. A heel attachment member 70 shown in the drawings is constructed primarily of aluminum and other corrosion resistant materials. Alternately, other strong lightweight water and corrosion resistant materials (like plastic materials) could be used integral with aluminum, or as a substitute for aluminum for some parts. Heel attachment member 70 adapts to fit all heel sizes by simple adjustment of the length of ankle strap 90 and heel buckle 84. Alternate fin assembly 104 which attaches to heel attachment member 70 is similar to fin assembly 20 illustrated and described in the first embodiment. To avoid repetition it is not in its entirety separately illustrated and described. Changes in the fin latching mechanism can be understood from the fin extension arm segments shown and described in drawings of FIGS. 9A, 9B, & 9C, and the exploded view in FIG. 10.

FIG. 9 shows a side view of the inside side of the left fin to illustrate the positioning of alternate fin assembly 104 in the alternate heel-attached embodiment. The drawing shows the pivoting of the fin between the extended and retracted positions, and the angle of the fin to the sole of the user's foot, indicated as angle X. This angle and relative considerations of it are the same as in the description of FIG. 4 of the first described embodiment.

FIG. 9A is a top view of heel attachment member 70. Phantom lines in FIGS. 9A, 9B, & 9C illustrate the outline of the nominal largest and smallest heel sizes (and in FIG. 9A, an intermediate size) to which the opening of heel plate 72 is shaped to conform. "Toothed" heel locating tabs 74 are formed as part of heel plate 72. Heel locating tabs 74 are positioned on heel plate 72 to make a firm two point contact with all intermediate heel sizes, providing a secure fastening to all sizes of wading footgear. A fin pivot guide 76 and a fin stop 78 are integral with heel attachment member 70 (welded in the illustrated embodiment, but they could be cast or molded as one integral part in other variations, or in still other variations, bolted to allow a shim adjustment to compensate for a natural outward or inward pointing of the user's feet). Fin stop member 78 is formed with detents 80 and 82 that retain alternate fin assembly 104 in either the extended or retracted position.

FIG. 9B shows heel attachment member 70 viewed from behind the wearer's foot. The illustration shows details of the fin pivot and latching mechanism, and a segment of alternate fin arms 102. A fin pivot shaft 92 passes through both alternate fin arms 102, and both fin pivot stop members 78, retained in position by fin pivot guide 76. Coil compression springs 94 are retained on fin pivot shaft 92 by retaining washers 96 and pivot retaining pins 98. When alternate fin assembly 104 pivots from either the extended or retracted position, alternate fin arms 102 move outward, releasing fin detent balls 106 from detents 80 and 82 allowing alternate fin assembly 104 to pivot to the opposite position.

FIG. 9 C is a side view of the inside side of heel attachment member 70 showing a heel buckle 84 which is an over-centering cam action buckle similar to that commonly used on downhill ski boots. A heel clamp cable 86 attaches to heel plate 72 on the outside side of heel attachment member 70 passing around the front of the heel to attach to one of a plurality of adjustment hooks on the inside of heel buckle 84. The adjustment hooks on heel buckle 84 compensate for the different lengths of fit of different size heels. Ankle strap 90 (shown in FIG. 9) is a commonly known and used strap and buckle affixed to a strap fitting 88 at the top of heel attachment member 70. Ankle strap 90 secures the upper part of heel attachment member 70 to the user's foot. Future production models would have a molded cap covering the fin pivot shaft ends and springs, but this has been omitted for clarity in illustrating functional details of the fin pivot and latching means.

FIG. 10 is an exploded view of the alternate heel attachment member 70, showing details of the fin pivot and latching mechanism.

OPERATION - FIGS. 1 TO 10

Where, for simplicity, a singular word form or singular reference numeral is used in the following description of the operation of the foot fins of this invention, it should be understood that the use of a singular form is not to imply there being only one fin, but it should be understood that there are paired left and right fins. Operation of both the first described and alternate embodiments is substantially the same. Reference numerals specifically pertaining to parts of the alternate embodiment are bracketed thus: [0].

In use the complete foot fin, with fin assembly 20 [104] in the retracted position is secured to the user's foot by foot-attachment member 40 [70]. On entering water of sufficient depth that the user is supported by the float tube seat, the user pivots fin assembly 20 [104] downward from the retracted position with his/her hand and/or opposite foot, disengaging fin assembly 20 [104] from its retracted position detents 56 [80, 82]. With fin assembly 20 [104] in a partly extended position the user moves his/her leg to the rear in a full striding movement, completing rotation of fin assembly 20 [104] to the fully extended position by pressure of the water against fin assembly 20 [104]. Alternately rotation to the fully extended position can be completed by continued use of the opposite foot. In its extended position the fin is located below the user's foot as a leveraged extension of the user's leg, increasing overall efficiency.

Propulsion vane frame 36 propulsion vanes 30 and propulsion vane hinges 32 are designed so vanes 30 feather, creating minimal drag when the user's leg is moved toward the front. Propulsion vanes 30 fully close when the user's leg is moved toward the rear, creating maximum resistance to movement against the water, and a resultant forward thrust. In this manner propulsion vanes 30 function to cause fin assembly 20 [104] to have a directionally differential resistance to movement through the water as a means of propelling a float tube forward in the water by movement of the user's legs in a forward and backward striding motion.

Efficiency of the fin is high, since it creates only a minimal drag on the forward (reset) movement of the leg, but creates maximum resistance on movement of the leg to the rear. Movement of the legs to provide forward thrust is similar to a normal walking stride with which users are familiar. The resultant forward propulsion is in the direction in which the user wishes to travel. Movement requires less effort than that required using prior art fins that propel the float tube backward from a swimmer's "flutter kick," or from prior art forward propelling fins.

On preparing to leave the water (while seated in the float tube) the user releases fin assembly 20 [104] from the extended position detents 54 [80, 82] by pressing the fin against the earth at the bottom of the body of water, or by pressure from the opposite foot. Rotation to the retracted position is then completed using the opposite foot and/or the user's hands. When both fins have been secured in the retracted position, the user can walk from the water in a normal manner, unrestricted by the fins.

SUMMARY, RAMIFICATIONS, AND SCOPE

Accordingly, the reader will see that the fin of this invention is an efficient device for propelling a float tube in a forward direction in the water. Walking in marginal water and on land is unrestricted by the retracted fin, reducing the danger of stumbling and falling.

While my preceding description contains many specificities, these should not be construed as limitations on the scope of the invention, but rather as an exemplification of one preferred embodiment thereof. Many other variations, substitutions and modifications are possible. For example, other means of attaching the fin assembly to the user's foot could include wading boots or footgear (as normally used with neoprene waders), to which a pivotal means of attaching the fin assembly is permanently or removably affixed, replacing the foot-attachment means that I have illustrated and described. Other flow controlling means could replace the propulsion vanes I have illustrated and described, and/or the propulsion vanes could be oriented in a different plane than illustrated. The fin size and configuration could be altered. For example, in a handicapped version the fin could be made larger and/or scooped to be more usable by persons having mobility of only one leg. I have described paired, left and right fins but other modifications could be for duplicates of a single fin, usable interchangeably on either foot, and/or for multi-part assemblies where I have shown one integral part. These, and/or other changes or modifications may be made by those skilled in the art without departing from the invention in its broader aspects.

Where, for simplicity in the preceding specification and the appended claims, a singular word form or reference number is used to describe a part, or parts of the invention, it should be assumed to not necessarily exclude a plurality, as for example describing a fin should also be assumed to mean as well a plurality of fins (left and right fins).

Accordingly, the scope of the invention should be determined in its broader aspects, not only by the embodiments illustrated, but by the appended claims and their legal equivalents. Therefore, the aim in the appended claims is to cover all such changes, substitutions, and modifications as fall into the true spirit and scope of the invention as defined by the following claims.

I claim:

1. A retractable fin assembly for attachment to the boot of a float tube user, said boot having a heel and a sole, said assembly comprising:

a fin member movable between a first position projecting below said boot adapted for propelling said float tube user forwardly in the water and a second position adapted for retraction relative to the heel of said boot to permit walking on land by said float tube user;

propulsion vane means carried by said fin member and having a closed position providing substantial resistance to the flow of water as said fin member is moved in a rearward direction relative to said user, and an open position for providing substantially reduced resistance to the flow of water as said fin member is moved in a forward direction relative to said user; and means for attaching said fin member to the boot of a user such that said first position provides an acute angle between said fin member and said boot sole as said fin member projects downwardly and away from the toe of said boot, and said second position aligns said fin member behind said heel above said sole proximate the leg of said user.

2. The assembly as claimed in claim 1, wherein said assembly further includes means for releasably latching said fin member in each of said first and second positions.

3. The assembly as claimed in claim 1, wherein said propulsion vane means comprises a frame and a plurality of elongated flaps hingedly secured to said frame substantially parallel to each other.

4. The assembly as claimed in claim 3, wherein said flaps are attached to said frame to move from said closed position wherein said flaps lie in substantially the same plane to form a surface to resist water flow, to said open position wherein said flaps are oriented approximately 90° to project outwardly from said plane in substantially parallel fashion to reduce resistance to water flow between the flaps.

5. The assembly as claimed in claim 4, wherein said frame further includes stop members to maintain said flaps in said closed position as water pressure increases against the surface of said flaps.

6. The assembly as claimed in claim 5, wherein said flaps are normally positioned intermediate said closed and said open positions and are moved to each said closed and open position in response to water flow against said flaps.

7. The assembly as claimed in claim 6, wherein said flaps are hingedly secured to said frame to move to said closed position in response to rearward movement of the leg of a user causing movement in a rearward direction of said fin member, and also to move to said open position in response to forward movement of the leg of a user causing movement in a forward direction of a fin member.

8. The assembly as claimed in claim 4, wherein the acute angle between said fin member and said boot sole is approximatley 55°–75°.

9. 8. The assembly as claimed in claim 1, wherein said assembly further includes hinge means for hingedly securing said fin member to said fin member attaching means for movement between said first position and said second, retraction position.

10. The assembly as claimed in claim 9, wherein said hinge means is positioned rearwardly of said heel.

11. The assembly as claimed in claim 1, wherein said fin member attachment means includes a releasable attachment member mountable to said user's boot and means for movably securing said fin member to said boot attachment member.

12. A fin assembly for attachment to the boot of a float tube user and adapted for selective movement between an operating position for propelling the float tube user in a forwardly facing direction and a retracted position for enabling a float tube user to walk on land, said fin assembly comprising:

a fin member movable between said operating position and said retracted position and including vane means having a closed position for providing substantial resistance to the flow of water in a first direction and an open position for providing minimal resistance to the flow of water in a second, opposite direction;

means for attaching said fin member to the boot of a user to orient said fin member in its operating position such that said vane means are in said closed position as said fin member is moved by the leg movement of a user in a rearward direction relative to the float tube user to propel said float tube user in said forwardly facing direction; and means for releasably locking said fin member in said retracted position rearwardly of said boot proximate the lower leg of a user and for releasably locking said fin member in said operating position projecting below said boot at an acute angle away from the toe of said boot.

13. The assembly as claimed in claim 12, wherein said fin member includes a frame defining a plane, and said vane means provides a plurality of elongated flaps hingedly secured to said frame substantially parallel to each other.

14. The assembly as claimed in claim 13, wherein said elongated flaps are attached to said frame to move from said closed position wherein said flaps lie in said plane to form a surface to resist water flow, to said open position wherein said flaps are oriented approximately 90° to said plane in substantially parallel fashion to substantially decrease resistance to water flow between said flaps.

15. The assembly as claimed in claim 14, wherein said flaps are normally positioned intermediate said closed and opened positions and are moved to each said closed and opened position in response to flow of water against said flaps in one of two opposite directions, said frame further including stop members to maintain said flaps in said closed position when water pressure is increased against the surface of said flaps.

16. The assembly as claimed in claim 13, wherein said assembly further includes hinge means for hingedly securing the upper edge of said frame adjacent one end of said flaps to said boot attachment means for movement between said first position inclined downwardly and rearwardly from said boot sole and said second retraction position inclined substantially in a vertical plane relative to said boot sole behind said heel.

17. The assembly as claimed in claim 16, wherein said hinge means comprises a hinge assembly disposed at the rear of the heel of a user's boot and attached to the upper edge of said frame.

18. The assembly as claimed in claim 16, wherein said frame further includes a pair of attachment arms, and wherein said hinge means comprises a hinge member attaching the terminal end of each said attachment arm to said boot attachment means.

19. A fin assembly for attachment to the boot of a float tube user and adapted for selective movement between an operating position for propelling the float tube user in a forwardly facing direction and a retracted position for enabling a float tube user to walk on land, said fin assembly comprising:

boot attachment means for releasbly securing said assembly to the boot of a user;

a fin member movable between said operating position aligned below and rearwardly from the sole of said boot, and said retracted position aligned behind and upwardly from the heel of said boot proximate the back of a user's lower leg;

means for hingedly attaching said fin member to said boot attachment means for movement between said operating and said retracted positions;

vane means carried by said fin member and having a closed position for providing substantial resistance to the flow of water in a first direction and an open position for providing minimal resistance to the flow of water in a second, opposite direction when said fin member is in its operating position, said vane means being in a closed position as said fin member is moved by the leg movement of a user in a rearward direction relative to the float tube user to propel said float tube user in said forwardly facing direction;

means for releasably locking said fin member in its retracted position; and means for releasably locking said fin member in its operating position at an acute angle relative to the bottom of said boot away from the toe of said boot.

20. The assembly as claimed in claim 19, wherein said hinge means comprises a hinge attaching one edge of said fin member to said boot attachment means proximate the rear of the heel of a user's boot.

* * * * *